United States Patent [19]

Frund et al.

[11] Patent Number: 4,621,506

[45] Date of Patent: Nov. 11, 1986

[54] KNITTING MACHINE

[75] Inventors: Louis Frund, Monthey; Marcello Baseggio, Ollon, both of Switzerland

[73] Assignee: Atelier De Construction Steiger S.A., Switzerland

[21] Appl. No.: 820,699

[22] Filed: Jan. 21, 1986

[30] Foreign Application Priority Data

Jan. 29, 1985 [EP] European Pat. Off. ..... 85200092.6

[51] Int. Cl.[4] ..... D04B 7/00; D04B 15/66

[52] U.S. Cl. ..... 66/75.1

[58] Field of Search ..... 66/75.1, 75.2, 115

[56] References Cited

U.S. PATENT DOCUMENTS 3,699,782 10/1972 Hadam ..... 66/75.1

3,955,381 5/1976 Panchaud ..... 66/75.1

4,490,994 1/1985 Essig ..... 66/75.1

4,554,803 11/1985 Schmodde et al. ..... 66/75.2

*Primary Examiner*—Ronald Feldbaum

*Attorney, Agent, or Firm*—Kane, Dalsimer, Kane, Sullivan and Kurucz

[57] ABSTRACT

Each needle groove formed in the needle bed of the knitting machine for slidably receiving the corresponding needle comprises a first dip registering with the major portion of the needle in the longitudinal direction, as well as a second, deeper dip engageable by a bent portion of the needle catch when this catch is retracted in the groove by a cam so as to clear the catch from the cam path, notably the path of the knockwing-over cam. When the needle is pushed by the key associated therewith or when this needle is selected in its operative position, the bent portion of the needle is raised by a ramp for engagement with the first, shallower dip.

6 Claims, 3 Drawing Figures

KNITTING MACHINE

BACKGROUND OF THE INVENTION

The present invention relates to a knitting machine comprising at least one needle bed having slidably mounted in its grooves corresponding needles formed with at least one catch or heel adapted to be positioned at two levels with respect to the top surface of the needle bed, that is, one level in which each needle catch can be driven by the cams or cam holders and another level in which the needle catch is clear of the path of said cams; means for acting upon said catches and moving them to the positions corresponding to said two levels, one of said means consisting of a cam adapted to depress said catches toward the lower level, and key means associated with each needle for moving the needles to their operative position in which they can be driven by the working cams.

THE PRIOR ART

When knitting Jacquard patterns, notably during the so-called 'arrowing' phase, inoperative needles happen to carry so-called 'waiting' loops. The knocking-over of these needles is not only useless but likely to cause the breakage of the waiting loops at each carriage pass. Increasing the speed of knitting machines increases the risk of breakage due to the greater acceleration to which the needles are subjected during the knocking-over, the breaking stress increasing in proportion to the square of the velocity. As a consequence of the increment in the working speed, the needles are also exposed to considerably greater acceleration and braking stresses. The vibration and the wear and tear of the cams and needles also increase in proportion. It is therefore necessary to avoid as much as possible any useless shocks. This is observed move particularly during the needle knocking-over. For these various reasons, it is desirable to avoid the knocking-over of momentarily inoperative needles by sinking the catches or heels of these needles in the needle bed so that they cannot be engaged by the knocking-over cams.

In a known proposition disclosed in the German Patent No. DE-A-2755471 the needles are provided with a resilient hairpin-shaped extension formed integrally or not with the needle body. The end of this hairpin carries the needle catch. Thus, it is possible, by means of a suitable cam, to bend the hairpin and pull the needle backwards so that a bearing portion of the hairpin will catch a special bar so as to hold the catch in its depressed or sunk position. However, the elbow of the resilient hairpin constitutes a weak point, even if the hairpin or even the complete needle, in case the hairpin or needle consisted of a single piece of metal, are made of high-tensile strength steel. In any case, a needle of this type would be extremely expensive to manufacture.

Another known proposition consisted in pivotally coupling the needle to its key or sinker. Now this pivotal coupling must necessarily be made with a high degree of precision in order to avoid any excessive play between the needle of the key, since such excessive play would cause irregularities to develop in the loop size and consequently in the knitted product. Considering the small dimensions of the needle and key, this pivotal coupling constitutes a weak point, not to mention the wear resulting in an increased play.

It is the primary object of the present invention to provide stronger and more reliable means, free of any resiliency or critical pivotal couplings, for retracting the catches of momentarily inoperative needles in a knitting machine.

These means are free of any resilient elements or other coupling means likely to cause failures. The change in the needle shape at the catch end can be made very easily without impairing the needle strength, this change assisting in fact in improving a certain resiliency which is necessary in the longitudinal direction for damping out the transmission of the shock received by the catch in the direction of the needle hook. This result is obtained without increasing the needle length. No additional element is required for holding the catch in its retracted position beneath the top surface of the needle bed.

The knitting machine concerned may be either a flat rib rectilinear top-machine or a horizontal double needle bed, or a horizontal dial machine.

THE DRAWINGS

DESCRIPTION OF THE PREFERRED EMBODIMENT

Figure 1:
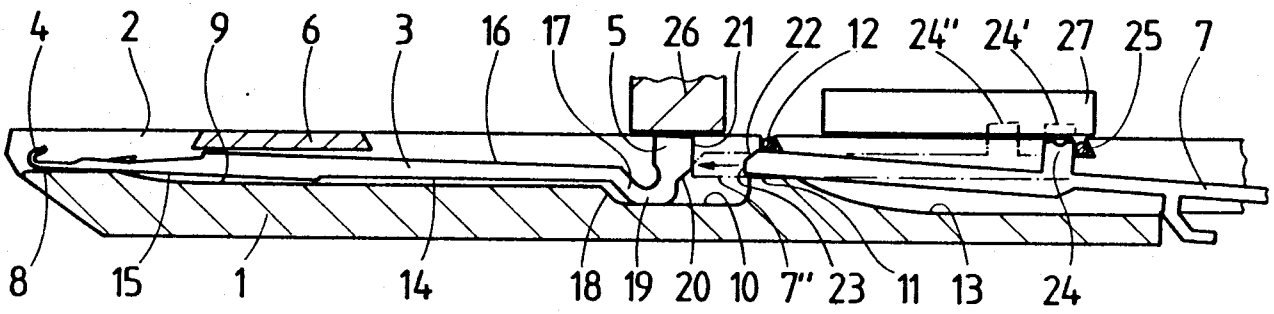
FIG. 1 is a vertical section taken through a needle bas or bed, showing a typical form of embodiment of the invention, the needle catch 17 being shown in its sunk position.

For the sake of clarity, the needle bed or bar 1 is shown in a horizontal position, but of course its normal position is usually oblique. A needle 3 provided with a hook 4 well known per se and with a catch or heel 5 at its near end is slidably fitted in a groove 2 formed in the needle bed. During its movement in the needle bed, the needle 3 is guided between the bottom of groove 2 and a bar 6 also known per se which extends throughout the length of the needle bed. Each needle 3 is moved to its operative position by a key 7 of particular configuration, adapted to be set at several levels in the needle bed and associated with an auxiliary key (not shown) of an individual selection device described in detail in the Swiss Patent CH 632,024. In this reference patent, the key 7 of the present specification bears the reference numeral '8'.

The bottom of groove 2 comprises a first section 8 extending along the hook portion 4 of the needle and corresponding to the usual bottom of a groove of this type. This first section 8 is followed by a first, shallow dip 9 of constant depth, except for the portion connecting this dip 9 to the first section 8. This first dip 8 is followed by a second, deeper dip 10 registering with the needle catch 5. This second dip 10 may be either machined in each groove 2 or obtained by milling throughout the length of the needle bed. This second dip 10 is followed by a section 11 level with section 8 and adapted to guide the key 7 which is retained in the groove by a steel wire 12. This section 11 is followed in turn by a relatively wide clearance 13 enabling the key 7 to tilt back in the groove when the key is driven by its auxiliary key, as described in the above-mentioned Swiss Patent CH 632,024.

The needle 3 comprises along part of its length a recessed portion 14 corresponding to an upswept portion of its lower edge, so that this portion is slanting with respect to both rectilinear and parallel sides 15 and 16 of a conventional needle. This clearance 14 extends in the direction of the catch 5 toward an oblique bent portion 17 interconnecting the main portion of needle 3 and the catch or heel 5. The lower edge of this bent portion 17 is substantially parallel to the ramp 18 interconnecting the dips 9 and 10 of groove 2. The lower section 19 of the cranked portion interconnecting the catch 5 and the needle body constitutes a kind of sliding shoe. It will be seen that the non-rectilinear coupling between the catch 5 and the needle body imparts a desired, predetermined resiliency to the needle so as to damp out the transmission to the hook 4 of the shocks exerted on said catch 5. On its side adjacent the key 7 the catch 5 is provided with a ramp 20 underlying a face 21 perpendicular to the top surface of the needle bed. The end of said key 7 is also provided with a ramp 22 parallel to the ramp 20 of catch 5 when the key 7 is in a preselected position, that is, in its upper position. The key 7 has a front face 23 disposed in a plane at right angles to the top surface of the needle bed. Furthermore, this key 7 is provided with an upstanding stud 24 and retained in its upper position by another steel wire 25 extending throughout the length of the needle bed, this wire 25 also urging the key stud 24 to a retracted or preselection position.

Figure 2:
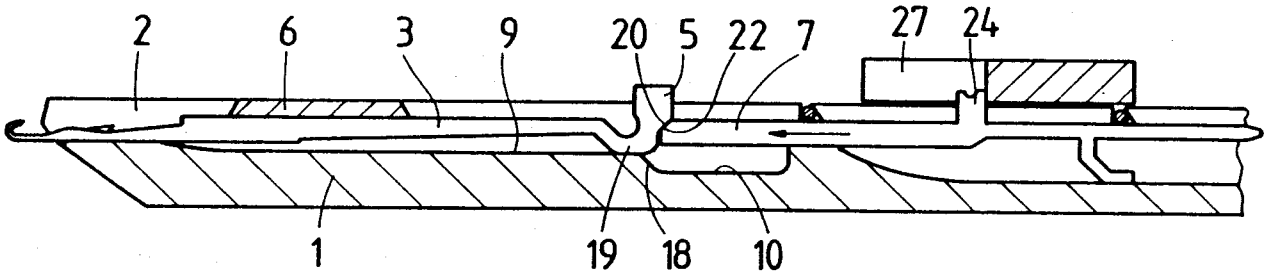
FIG. 2 is a sectional view similar to FIG. 1 showing the needle moved to its operative position by the key associated therewith.
Figure 3:
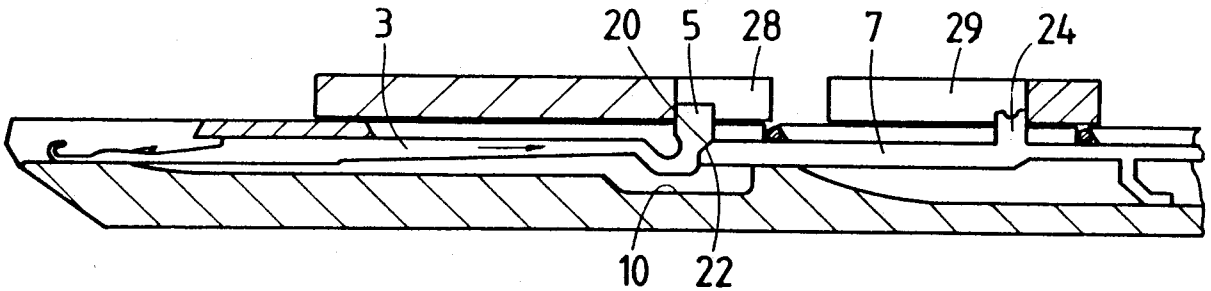
FIG. 3 is a similar sectional view showing the knocking-over of the needle by a knocking-over eccentric or cam.

The mode of operation of the device will now be described with reference to FIGS. 1–3.

As illustrated in FIG. 1, the catches 5 of all the needles are firstly sunk into the needle bed 1 by a special cam 26 rigidly connected to the cam holding carriage (not shown). When inoperative, the keys 7 are in position 24'.

When a needle is selected by the section device, the relevant key 7 is released, as described in the abovementioned Swiss Patent CH 632,024, and moves to position 24' while the keys of the nonselected needles are retained in position 24. The selected key is then driven by a cam of the cam holder illustrated diagrammatically at 27 and its leading end strikes with its front face 23 the catch 5 of the corresponding needle, as illustrated at 24''. The needle 3 is thus thrusted forwards and its bent portion 17 engages the ramp 18 on which the sliding shoe 19 rises before moving along the section 9, as illustrated in FIG. 2. During this upward movement of the needle, the ramp 22 of key 7 is caused to slide on the ramp 20 of catch 5, thus assisting in lifting the catch while urging the needle in the forward direction. When the shoe 19 of the needle overlies the section 9 of groove 2, the catch 5 projects from the needle bed and can thus be caught by the working cams of the cam holder. The needle knocking-over position is shown in FIG. 3. The catches 5 of needles 3 are driven backwards by a knocking-over cam or eccentric 28. When the catches 5 register with dip 10, these catches should be positively prevented from dropping into this dip. For this purpose, the catches 5 are supported until they complete their knocking-over stroke by the keys 7 having their heels guided by a cam 29 of the cam holder. Both cams 28 and 29 constitute a kind of channel of uniform width in which the needle and key assembly is guided as if it constituted a one-piece unit. Then the keys 7 continue alone their backward movement and thus release the needle catches 5 until they resume their initial, inoperative position 24' (FIG. 1).

Of course, the specific form of embodiment described hereinabove by way of example should not be construed as limiting the present invention, since many modifications and changes may be brought thereto without departing from the basic principles of the invention. Thus, notably, the recessed portion 14 of the needle is theoretically optional. However, the presence of this recess is preferable so that the full height of the catch can be utilized when moving from the lower position to the upper position. Furthermore, the bent portion 17–19 of the needle could have a regular or irregular curvature instead of comprising a rectilinear section 17. The dip 10 of the needle bed groove may be obtained by means of a complete break in the needle bed. Thus, a bar could be fitted in this break for obtaining a bottom similar to the bottom 10 illustrated. The catches could be retained in their sunk or retracted position by magnetic means, notably fixed magnets, or a strip of plastic material having ferrite particles embedded therein.

What is claimed as new is:

1. A knitting machine comprising at least one needle bed having slidably mounted in its grooves a plurality of needles provided with at least one catch adapted to be positioned at two levels with respect to the top surface of the needle bed, namely one level whereat the catch can be driven by the cams of the cam holder, and another level whereat the catch is clear from the path of said cams, means for acting upon said catches so as to cause them to be set in positions corresponding to said two levels, respectively, one of said means consisting of a cam adapted to push said catches back to their lower level, and keys associated with each needles for moving said needles to their operative position, in which said needles can be driven by the working cams, wherein said needle bed grooves comprise a first dip registering with the major portion of the length of the needle in the inoperative position thereof, said first dip being followed by a second, deeper dip registering with the catch of the needle in the inoperative position thereof and connected through a ramp to said first dip, said needles comprising, beneath the needle catch and body, a bent portion interconnecting the catch and body of the needle, whereby, when the catch of an inoperative needle is pushed down to its lower level, the bend portion of the needle engages said second dip and, when the needle is pushed forwards by the key associated therewith, said bent portion abutes said ramp of the needle bed, thus causing the upward movement of said catch up to its upper level.

2. The knitting machine of claim 1 wherein the lower portion of the needle catch which is adjacent said key is provided with an oblique ramp adapted to cooperate with a corresponding ramp formed on the end of said key for supporting said catch in its upper position during the knocking-over of said needle.

3. The knitting machine of claim 2, wherein said cam holder comprises a cam adapted to guide and retain said key by engaging the catch of said key during the knocking-over of said needle, whereby the key end remains in bearing engagement through its ramp with the oblique ramp of said needle catch.

4. The knitting machine of claim 3, wherein the needle catch portion adjacent the corresponding key has a face perpendicular to the needle bed which overlies said oblique ramp, said key being adapted to engage with its end said perpendicular face when the needle catch is in its lower position.

5. The knitting machine of claim 1, wherein said needles comprise on their lower sides a recessed portion extending along one fraction of their length from said bent portion.

6. The knitting machine of claim 1, wherein magnetic retaining means are provided on the bottom of said second dips.

* * * * *